US005197421A

United States Patent [19]

Hara

[11] Patent Number: 5,197,421

[45] Date of Patent: Mar. 30, 1993

[54] VALVE TIMING CONTROL APPARATUS

[75] Inventor: Seinosuke Hara, Kanagawa, Japan

[73] Assignee: Atsugi Unisia Corporation, Atsugi, Japan

[21] Appl. No.: 919,741

[22] Filed: Jul. 27, 1992

[30] Foreign Application Priority Data

Jul. 31, 1991 [JP] Japan ..... 3-191759

[51] Int. Cl.[5] ..... F01L 1/34

[52] U.S. Cl. ..... 123/90.17; 123/90.31; 74/568 R; 74/567; 464/2; 464/160

[58] Field of Search ..... 123/90.15, 90.17, 90.31, 123/90.12, 90.13; 74/568 R, 567; 464/1, 2, 160

[56] References Cited

U.S. PATENT DOCUMENTS 4,231,330 11/1980 Garcea ..... 123/90.15
5,088,456 2/1992 Suga ..... 123/90.31

FOREIGN PATENT DOCUMENTS 67407 3/1990 Japan ..... 123/90.15
2-27507 9/1990 Japan ..... 123/90.17
2-45407 10/1990 Japan ..... 123/90.17
2120320 11/1983 United Kingdom ..... 123/90.17

*Primary Examiner*—E. Rollins Cross
*Assistant Examiner*—Weilun Lo
*Attorney, Agent, or Firm*—Foley & Lardner

[57] ABSTRACT

A valve timing control apparatus comprises a rotary member drivingly connected to the crankshaft for rotation with rotation of the crankshaft, and a drive mechanism for transmitting rotation of the rotary member to the camshaft. The drive mechanism includes a piston member provided for reciprocation to rotate the camshaft with respect to the rotary member. The piston member has a pressure chamber formed therein. The piston member is urged resiliently in a first direction. The piston member is movable in a second direction opposite to the first direction in response to a pressure introduced into the pressure chamber. The valve timing control apparatus also includes first and second conduit. The first conduit has a first outlet for connection to the pressure chamber. The second conduit has a second outlet for connection to the pressure chamber. The second outlet is spaced away from the first outlet in the first direction of movement of the piston member. First and second command signals are produced according to engine operating conditions. A pressure is introduced through the first conduit in the presence of the first command signal. A pressure is introduced through the second conduit in the presence of the second command signal.

11 Claims, 6 Drawing Sheets

VALVE TIMING CONTROL APPARATUS

BACKGROUND OF THE INVENTION

This invention relates to a valve timing control apparatus for use in an internal combustion engine to provide a desired valve timing(s) according to engine operating conditions.

For example, U.S. Pat. No. 4,231,330 discloses a valve timing control apparatus for controlling the intake or exhaust valve timing according to engine operating conditions. The valve timing control apparatus employs a cylindrical gear having internal and external threaded portions one of which is taken in the form of a helical gear. The external threaded portion engages with the inner threaded portion of a rotary drum which is formed on its outer peripheral surface with sprocket teeth for engagement with a timing chain engaging with a sprocket mounted on the crankshaft of the engine. The internal threaded portion of the cylindrical gear engages with the external threaded portion formed on the camshaft of the engine. The camshaft is rotated at an angle with respect to the rotary drum by applying fluid pressures to move the cylindrical gear in an axial direction of the camshaft.

However, the conventional valve timing control apparatus has a significant operational delay in responding to an engine load change particularly when the engine load changes an intermediate value to a high value.

SUMMARY OF THE INVENTION

It is a main object of the invention to provide an improved valve timing control apparatus which can operate in extremely fast response to an engine load change over the entire range of engine load conditions.

There is provided, in accordance with the invention, a valve timing control apparatus for use in an internal combustion engine having a crankshaft driven by the engine and a camshaft adapted to drive at least one valve. The valve timing control apparatus comprises a rotary member drivingly connected to the crankshaft for rotation with rotation of the crankshaft, and a drive mechanism for transmitting rotation of the rotary member to the camshaft. The drive mechanism includes a piston member provided for reciprocation to rotate the camshaft with respect to the rotary member. The piston member has a pressure chamber formed therein. The piston member is urged resiliently in a first direction. The piston member is movable in a second direction opposite to the first direction in response to a pressure introduced into the pressure chamber. A first conduit has a first outlet for connection to the pressure chamber. A second conduit has a second port for connection to the pressure chamber. The second port is spaced away from the first port in the first direction of movement of the piston member. The valve timing control apparatus also includes a control unit which includes means for producing first and second command signals according to engine operating conditions, means responsive to the first command signal for introducing a pressure through the first conduit, and means responsive to the second command signal for introducing a pressure through the second conduit.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
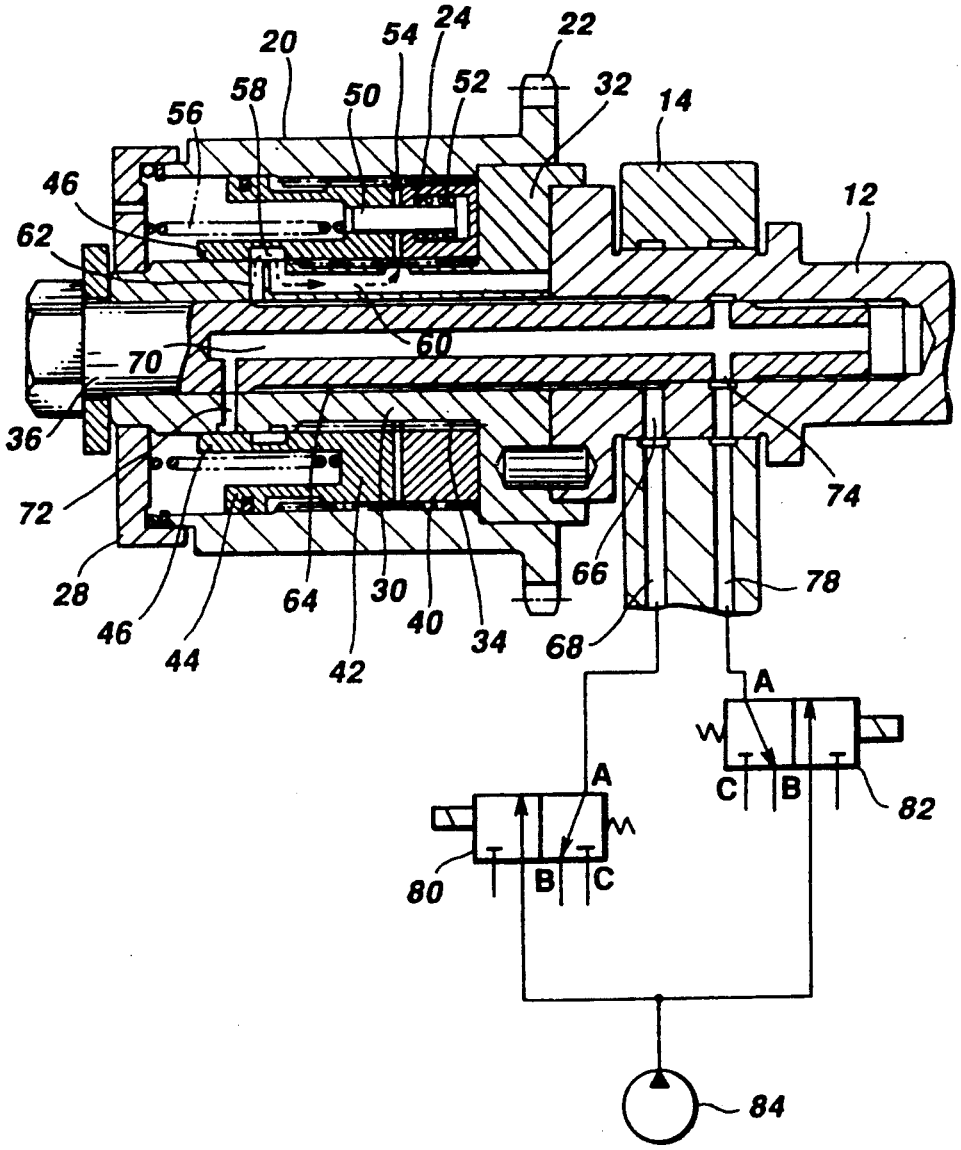
FIG. 1 is a longitudinal sectional view showing one embodiment of a valve timing control apparatus made in accordance with the invention.

With reference to the drawings and in particular to FIG. 1, there is shown a valve timing control apparatus embodying the invention. The valve timing control apparatus includes a rotary drum 20 formed on its outer peripheral surface with sprocket teeth 22 for engagement with a timing chain (not shown). The timing chain engages with a drive sprocket mounted on the engine crankshaft (not shown) for transmitting rotation of the engine crankshaft to rotate the rotary drum 20 at half the speed of the engine crankshaft. In the illustrated case, the valve timing control apparatus is applied to a DOHC type internal combustion engine including a camshaft 12 which is supported by a bearing 14 for rotation to drive unshown cams so as to open and close the respective intake valves of the engine. The bearing 14 forms a part of the cylinder head of the engine. The camshaft 12 is fixed at its rear end to a sleeve 30 for rotation in unison therewith by means of a bolt 36 extending axially through the sleeve 30 into the camshaft 12. The sleeve 30 is formed at its front end with an annular flange 32. The rotary drum 20 is rotatably supported on the sleeve 30 with its front end portion fitted around the annular flange 32 and its rear end portion closed by a circular end cover 28 having a center hole through which the sleeve 30 extends.

The valve timing control apparatus also includes two ring gears 40 and 42 placed in an annular space defined between the rotary drum 20 and the sleeve 30. The first ring gear 40 is formed on its outer peripheral surface with an externally threaded portion threadably engaged with the internally threaded inner peripheral surface 24 of the rotary drum 20 and on its inner peripheral surface with an internally threaded portion threadably engaged with the externally threaded outer peripheral surface 34 of the sleeve 30 so that the inner ring gear 30 can reciprocate within the annular space while rotating to rotate the sleeve 30 and thus the camshaft 12 with respect to the rotary drum 20. The outer ring gear 42 is formed on its outer peripheral surface with an externally threaded portion threadably engaged with the internally threaded inner peripheral surface 24 of the rotary drum 20 and on its inner peripheral surface with an internally threaded portion threadably engaged with the externally threaded outer peripheral surface 34 of the sleeve 30 so that the outer ring gear 42 can reciprocate within the annular space while rotating to rotate the sleeve 30 and thus the camshaft 12 with respect to the rotary drum 20. The second ring gear 42 has an annular groove to form a shorter annular outer rear end portion 44 and a longer annular inner rear end portion 46. A connection rod 50 connects the first and second ring gears 40 and 42 for movement toward and away from each other. The connection rod 50 is partially placed in a chamber formed in the first ring gear 40 and it extends through the second ring gear 42 into the annular groove. A coil spring 52 is placed in the chamber to urge the connection rod 50 in a direction moving the first and second ring gears 40 and 42 toward each other to reduce the volume of a first pressure chamber 54 defined between the first and second ring gears 40 and 42. A compression coil spring 56 is provided in the annular groove to urge the second ring gear 42 in a direction pushing the first ring gear 40 against the rear wall of the annular flange 32. The second ring gear 42 is formed in its outer peripheral surface with an annular groove which forms a second pressure chamber 58 along with the outer peripheral surface of the sleeve 30.

A conduit 60 extends axially through the sleeve 30 for connection of the second pressure chamber 58 to the first pressure chamber 54 defined between the first and second ring gears 40 and 42. Another conduit 62 extends radially through the sleeve 30 for connection of the second pressure chamber 58 to an annular conduit 64 defined between the sleeve 30 and the bolt 36. The annular conduit 64 is connected to a conduit 66 extending radially through the camshaft 12. The conduit 66 is connected through an annular groove to a conduit 68 extending through the cylinder head 14. A conduit 70 centrally extends axially through the bolt 36. The conduit 70 is connected at its one end through a conduit 72 extending radially through the bolt 36 and also through the sleeve 30 for connection of the second pressure chamber 58 to the axial conduit 70. The axial conduit 70 is connected at the other end thereof to a conduit 74 extending radially through the bolt 36. The conduit 74 is connected to a conduit 76 extending radially through the camshaft 12. The conduit 76 is connected to a conduit 78 extending through the cylinder head 14.

The valve timing control apparatus also includes first and second solenoid valves 80 and 82. The first solenoid valve 80 has two ports A, B and C. The port A is connected to the conduit 68, the port B is a drain port, and the port C is connected to an oil pump 84. The first solenoid valve 80 operates on a command current signal fed thereto from a control unit (not shown) to occupy one of two positions. The first position, illustrated in FIG. 1, is occupied in the absence of the command current signal to provide communication between the ports A and B so as to discharge the fluid pressure from the conduit 68. The second position is encountered in the presence of the command current signal to provide communication between the ports A and C so as to connect the conduit 68 to the oil pump 84. Similarly, the second solenoid valve 82 has two ports A, B and C. The port A is connected to the conduit 78, the port B is a drain port, and the port C is connected to the oil pump 84. The second solenoid valve 82 operates on a command current signal fed thereto from the control unit to occupy one of two positions. The first position, illustrated in FIG. 1, is occupied in the absence of the command current signal to provide communication between the ports A and B so as to discharge the fluid pressure in the conduit 78. The second position is encountered in the presence of the command current signal to provide communication between the ports A and C so as to connect the conduit 78 to the oil pump 84. Each of the command current signals to the respective solenoid valves 80 and 82 has two levels repetitively determined from calculations performed by the control unit. These calculations are made based upon various conditions of the engine that are sensed during its operation. These sensed conditions include engine speed, engine intake airflow, and engine coolant temperature.

Figure 2:
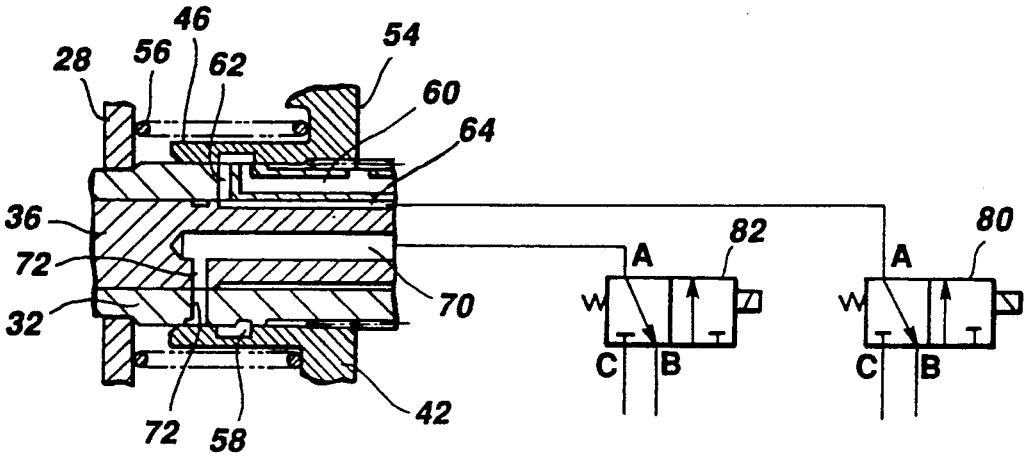
FIG. 2 is a fragmentary longitudinal sectional view of the valve timing control apparatus of FIG. 1 with the second ring gear in the rightmost position.

At low engine load conditions, the control unit produces no command current signal to the first and second solenoid valves 80 and 82. Since the first solenoid valve 80 is retained in its first position and the second solenoid valve 82 is retained in its first position, as shown in FIGS. 1 and 2, the fluid pressure in the first and second chambers 54 and 58 are discharged. As a result, the first ring gear 40 is held in abutment on the rear surface of the annular flange 32 with the second ring gear 42 being retained at its rightmost position, as viewed in FIG. 1, under the resilient force of the coil spring 56. At this rightmost position, the camshaft 12 is rotated at a greatest angle with respect to the rotary disc 20 in a direction retarding the timing of closure of the intake valves.

Figure 3:
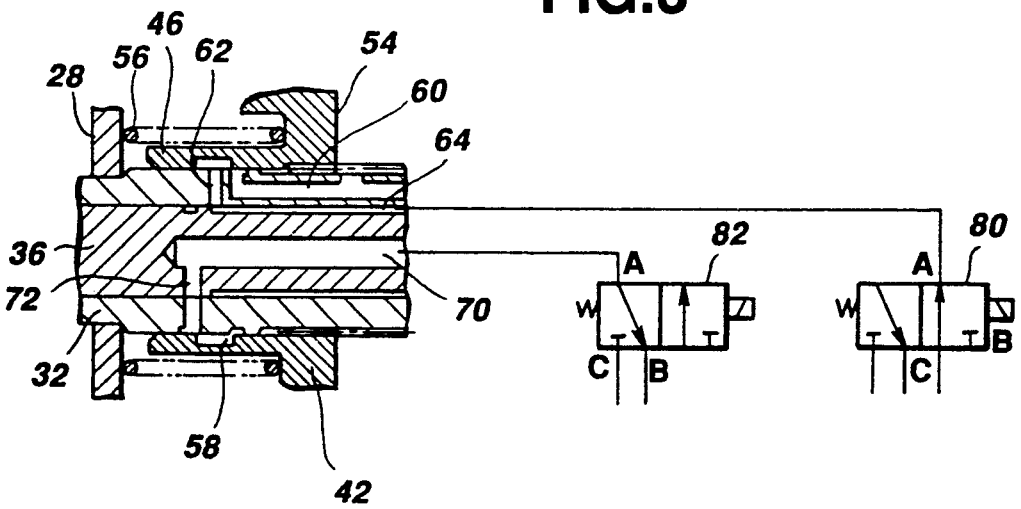
FIG. 3 is a fragmentary longitudinal sectional view of the valve timing control apparatus of FIG. 1 with the second ring gear in the intermediate position.

When the engine load increases to an intermediate value, the control unit produces a command current signal to change the first solenoid valve 80 to its second position providing communication between its ports A and C, as shown in FIG. 3. The fluid pressure, which is introduced through the first solenoid valve 80 from the oil pump 84 into the conduit 68, is introduced through the conduit 62 into the second pressure chamber 58 and hence through the conduit 60 into the first pressure chamber 54 to move the second ring gear 42 leftward, as viewed in FIG. 1, away from the first ring gear 40 against the resilient force of the coil spring 56 while rotating the second ring gear 42 to rotate the sleeve 30 and thus the camshaft 12 with respect to the rotary drum 20 in a direction advancing the timing of closure of the intake valves. When the second ring gear 42 moves a predetermined distance, the second pressure chamber 58 comes into partial registry with the conduit 72. In this case, the second solenoid valve 82 receives no command current signal from the control unit and occupies its first position providing communication between its ports A and B, as shown in FIG. 3. Thus, the fluid pressure is discharged from the second pressure chamber 58 through the conduit 72 to decrease the fluid pressure in the first pressure chamber 54. As a result, the second ring gear 42 moves rightward, as viewed in FIG. 1, toward the first ring gear 40 under the resilient force of the coil spring 56. The leftward and rightward movements of the second ring gear 42 are repeated and balanced to ensure that the second ring gear 42 can be retained at a predetermined intermediate position. At this intermediate position, the camshaft 12 is at a predetermined angle with respect to the rotary drum 20 to provide a predetermined advance or retard for the timing of closure of the intake valves.

Figure 4:
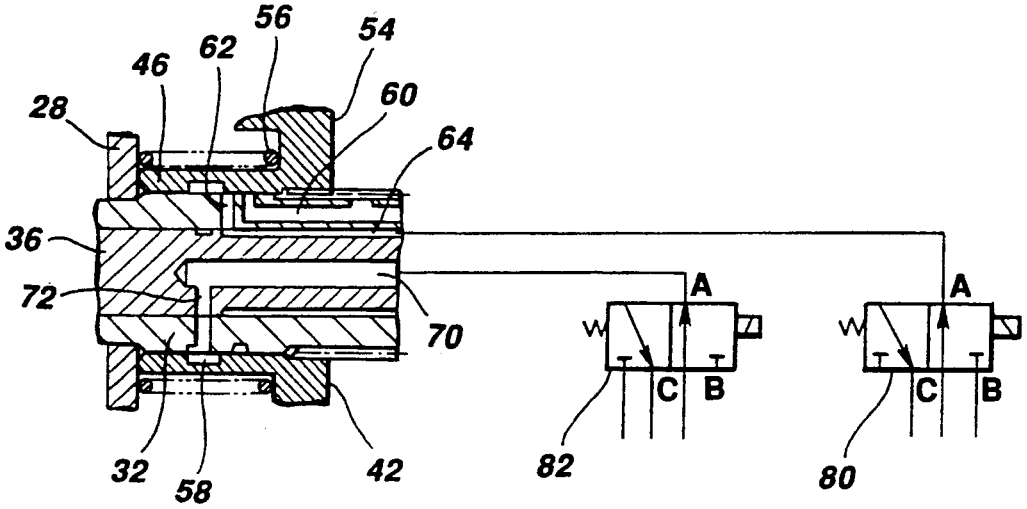
FIG. 4 is a fragmentary longitudinal sectional view of the valve timing control apparatus of FIG. 1 with the second ring gear in the leftmost position.

When the engine load increases further to a high value, the control unit produces a command current signal to change the second solenoid valve 82 to its second position providing communication between its ports A and C, as shown in FIG. 4. The fluid pressure, which is introduced through the second solenoid valve 82 from the oil pump 84 into the conduit 78, is introduced through the conduit 72 into the second pressure chamber 58. In this case, the first solenoid valve 80 receives the command current signal from the control unit and occupies its second position providing communication between its ports A and C, as shown in FIG. 4. The fluid pressure, which is introduced from the oil pump 84 through the first solenoid valve 80 into the second pressure chamber 58 and hence through the conduit 60 into the first pressure chamber 54, is increased by the fluid pressure introduced from the oil pump 84 through the second solenoid valve 82 into the second pressure chamber 58. This is effective to increase the fluid pressure in the first pressure chamber 54 and thus move the second ring gear 42 away from the first ring gear 40 at a rapid response rate with respect to a change from an intermediate engine load condition to a high engine load condition. The second ring gear 42 moves further leftward, as viewed in FIG. 1, away from the first ring gear 40 against the resilient force of the coil spring 56 while rotating the second ring gear 42 to rotate the sleeve 30 and thus the camshaft 12 with respect to the rotary drum 20 in a direction advancing the timing of closure of the intake valves until the longer annular inner rear end portion 46 comes in abutment on the cover 28. When the second ring gear 42 reaches at its leftmost position, the second pressure chamber 58 comes out of registry with the conduit 62. Consequently, the second ring gear 42 is retained at the leftmost position, as viewed in FIG. 1, by the fluid pressure introduced into the second pressure chamber 58 through the second solenoid valve 82 from the oil pump 84. At this leftmost position, the camshaft 12 is at a predetermined angle with respect to the rotary disc 20 to provide a maximum advance for the timing of closure of the intake valves.

When the engine load decreases to an intermediate value, the command current signal to the second solenoid valve 82 is interrupted. As a result, the second solenoid valve 82 changes to its first position providing communication between its ports A and B, as shown in FIG. 3, and it discharges the fluid pressure from the second pressure chamber 58. Since the fluid pressure charged in the first pressure chamber 54 decreases, the second ring gear 42 moves rightward, as viewed in FIG. 1, toward the first ring gear 40 under the resilient force of the coil spring 56. When the second ring gear 42 moves rightward, the second pressure chamber 58 comes into registry with the conduit 62. In this case, the first solenoid valve 80 receives the command current signal from the control unit and occupies its second position providing communication between its ports A and C. Thus, the fluid pressure is introduced through the first solenoid valve 80 from the oil pump 84 into the second pressure chamber 58 to move the second ring gear 42 leftward, as viewed in FIG. 1, away from the second ring gear 42 against the resilient force of the coil spring 56. The leftward and rightward movements of the second ring gear 42 are repeated and balanced to ensure that the second ring gear 42 can be retained at the predetermined intermediate position.

When the engine load decreases to a low value, the command current signal to the first solenoid valve 80 is interrupted. As a result, the first solenoid valve 80 changes to its first position providing communication of its ports A and B, as shown in FIG. 2, and it discharges the fluid pressure from the second pressure chamber 58. Since the fluid pressure charged in the first pressure chamber 54 decreases, the second ring gear 42 moves rightward, as viewed in FIG. 1, toward the first ring gear 40 until the second ring gear 42 reaches its rightmost position under the resilient force of the coil spring 56.

Figure 5:
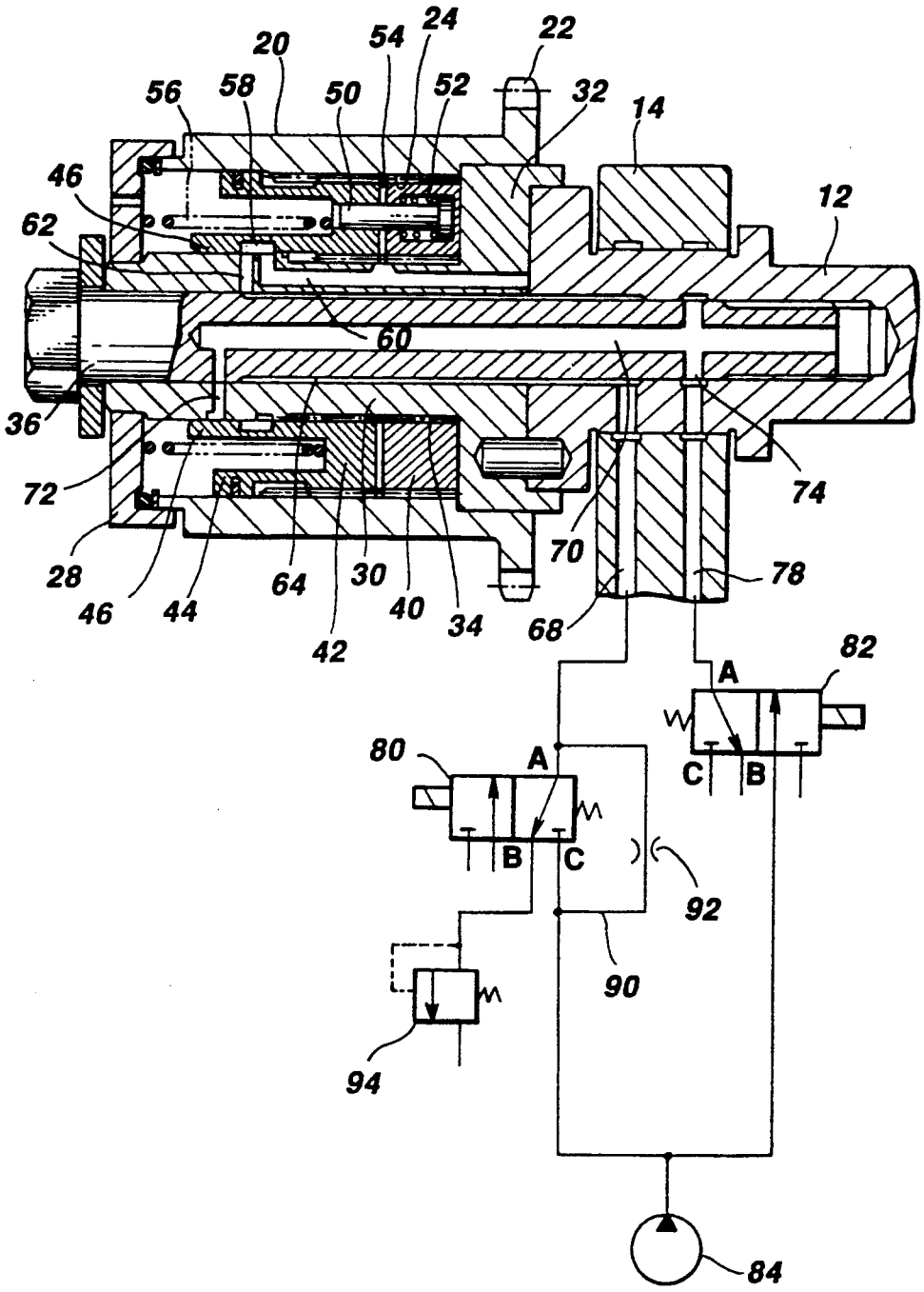
FIG. 5 is a fragmentary longitudinal sectional view showing a second embodiment of the valve timing control apparatus of the invention.
Figure 6:
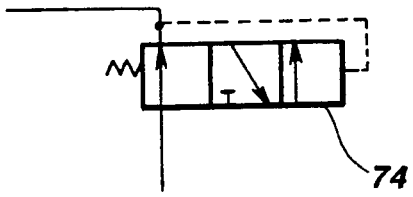
FIG. 6 is a schematic diagram showing one example of relief valve used in the valve timing control apparatus of FIG. 5.

Referring to FIG. 5, there is shown a second embodiment of the valve timing control apparatus of the invention with the same elements being designated by the same reference numerals. In this embodiment, an orifice 92 is provided in a bypass passage 90 connected between the ports A and B of the first solenoid valve 80. A relief valve 94 is connected to the drain port B of the first solenoid valve 80. As shown in FIG. 6, the relief valve 94 may be taken in the form of a solenoid valve of the internal pilot type operable in response to a pilot pressure produced at the drain port B of the first solenoid valve 80. The relief valve 94 relieves the fluid pressure created at the drain port B of the first solenoid valve 80 when it exceeds a predetermined value.

Figure 7:
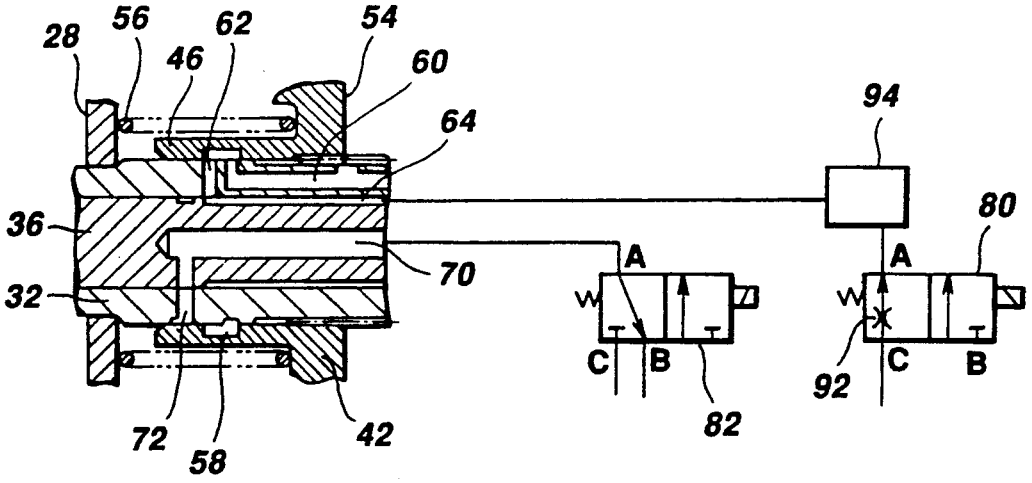
FIG. 7 is a fragmentary longitudinal sectional view of the valve timing control apparatus of FIG. 5 with the second ring gear in the rightmost position.

At low engine load conditions, the control unit produces no command current signal to the first and second solenoid valves 80 and 82. Since the first solenoid valve 80 is retained in its first position and the second solenoid valve 82 is retained in its first position, as shown in FIGS. 5 and 7, the fluid pressure in the first and second chambers 54 and 58 are discharged. As a result, the first ring gear 40 is held is abutment on the rear surface of the annular flange 32 with the second ring gear 42 being retained at its rightmost position, as viewed in FIG. 5, under the resilient force of the coil spring 56. At this rightmost position, the camshaft 12 is rotated at a greatest angle with respect to the rotary disc 20 in a direction retarding the timing of closure of the intake valves. In this case, a small amount of oil is supplied through the orifice 92 from the oil pump 84. A part of the oil is supplied through the conduit 68 into the first and second pressure chambers 54 and 58 for lubrication of the first and second ring gears 40 and 42. The remaining oil is supplied through the first solenoid valve 80 to the relief valve 94. Since the pressure of the oil supplied to the relief valve 94 is much less than the value predetermined for the relief valve 94, the oil cannot be discharged through the relief valve 94. This is effective to reduce the oil consumption and the oil pump capacity.

Figure 8:
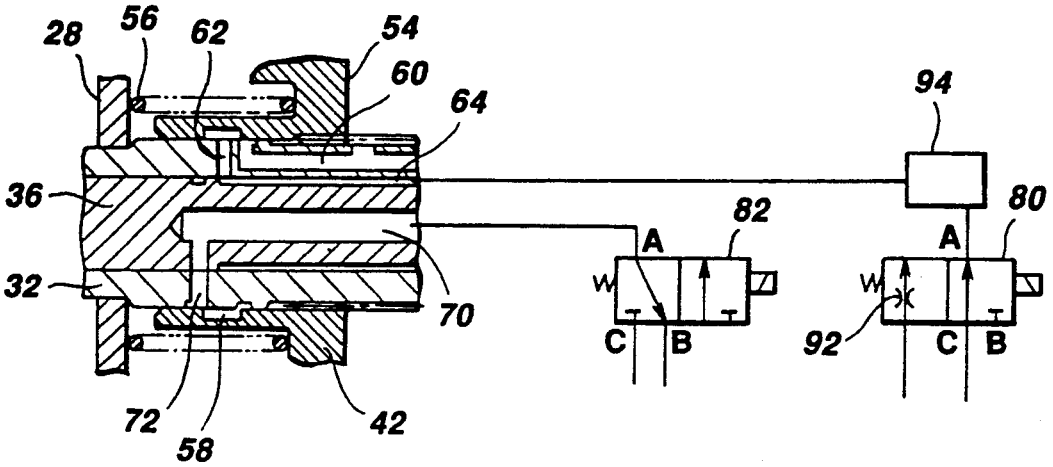
FIG. 8 is a fragmentary longitudinal sectional view of the valve timing control apparatus of FIG. 5 with the second ring gear in the intermediate position.

When the engine load increases to an intermediate value, the control unit produces a command current signal to change the first solenoid valve 80 to its second position providing communication between its ports A and C, as shown in FIG. 8. The fluid pressure, which is introduced through the first solenoid valve 80 from the oil pump 84 into the conduit 68, is introduced through the conduit 62 into the second pressure chamber 58 and hence through the conduit 60 into the first pressure chamber 54 to move the second ring gear 42 leftward, as viewed in FIG. 5, away from the first ring gear 40 against the resilient force of the coil spring 56 while rotating the second ring gear 42 to rotate the sleeve 30 and thus the camshaft 12 with respect to the rotary drum 20 in a direction advancing the timing of closure of the intake valves. When the second ring gear 42 moves a predetermined distance, the second pressure chamber 58 comes into partial registry with the conduit 72. In this case, the second solenoid valve 82 receives no command current signal from the control unit and occupies its first position providing communication between its ports A and B, as shown in FIG. 8. Thus, the fluid pressure is discharged from the second pressure chamber 58 through the conduit 72 to decrease the fluid pressure in the first pressure chamber 54. As a result, the second ring gear 42 moves rightward, as viewed in FIG. 5, toward the first ring gear 40 under the resilient force of the coil spring 56. The leftward and rightward movements of the second ring gear 42 are repeated and balanced to ensure that the second ring gear 42 can be retained at a predetermined intermediate position. At this intermediate position, the camshaft 12 is at a predetermined angle with respect to the rotary drum 20 to provide a predetermined advance or retard for the timing of closure of the intake valves.

Figure 9:
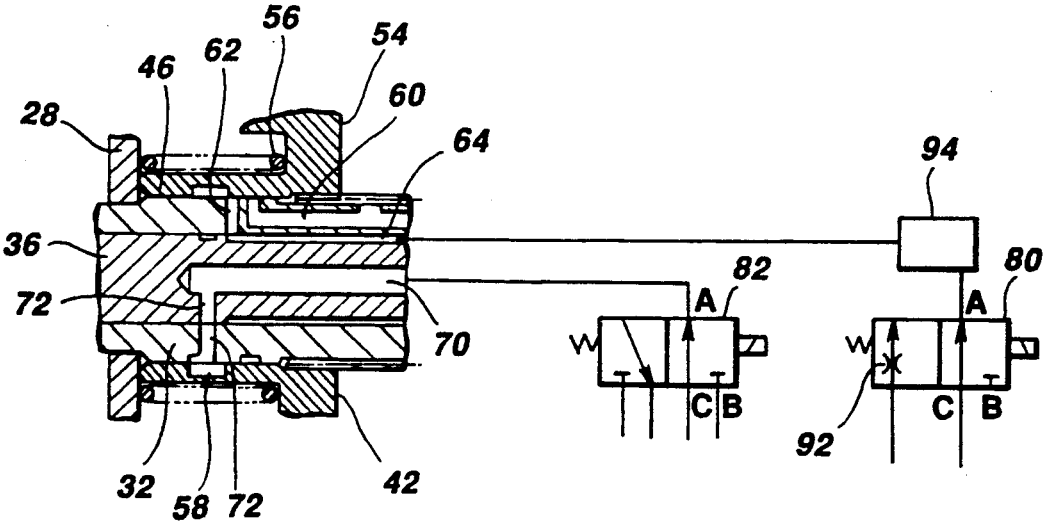
FIG. 9 is a fragmentary longitudinal sectional view of the valve timing control apparatus of FIG. 5 with the second ring gear in the leftmost position.

When the engine load increases further to a high value, the control unit produces a command current signal to change the second solenoid valve 82 to its second position providing communication between its ports A and C, as shown in FIG. 9. The fluid pressure, which is introduced through the second solenoid valve 82 from the oil pump 84 into the conduit 78, is introduced through the conduit 72 into the second pressure chamber 58. In this case, the first solenoid valve 80 receives the command current signal from the control unit and occupies its second position providing communication between its ports A and C, as shown in FIG. 9. The fluid pressure, which is introduced from the oil pump 84 through the first solenoid valve 80 into the second pressure chamber 58 and hence through the conduit 60 into the first pressure chamber 54, is increased by the fluid pressure introduced from the oil pump 84 through the second solenoid valve 82 into the second pressure chamber 58. This is effective to increase the fluid pressure in the first pressure chamber 54 and thus move the second ring gear 42 away from the first ring gear 40 at a rapid response rate with respect to a change from an intermediate engine load condition to a high engine load condition. The second ring gear 42 moves further leftward, as viewed in FIG. 5, away from the first ring gear 40 against the resilient force of the coil spring 56 while rotating the second ring gear 42 to rotate the sleeve 30 and thus the camshaft 12 with respect to the rotary drum 20 in a direction advancing the timing of closure of the intake valves until the longer annular inner rear end portion 46 comes in abutment on the cover 28. When the second ring gear 42 reaches at its leftmost position, the second pressure chamber 58 comes out of registry with the conduit 62. Consequently, the second ring gear 42 is retained at the leftmost position, as viewed in FIG. 5, by the fluid pressure introduced into the second pressure chamber 58 through the second solenoid valve 82 from the oil pump 84. At this leftmost position, the camshaft 12 is at a predetermined angle with respect to the rotary disc 20 to provide a maximum advance for the timing of closure of the intake valves.

When the engine load decreases to an intermediate value, the command current signal to the second solenoid valve 82 is interrupted. As a result, the second solenoid valve 82 changes to its first position providing communication between its ports A and B, as shown in FIG. 8, and it discharges the fluid pressure from the second pressure chamber 58. Since the fluid pressure charged in the first pressure chamber 54 decreases, the second ring gear 42 moves rightward, as viewed in FIG. 5, toward the first ring gear 40 under the resilient force of the coil spring 56. When the second ring gear 42 moves rightward, the second pressure chamber 58 comes into registry with the conduit 62. In this case, the first solenoid valve 80 receives the command current signal from the control unit and occupies its second position providing communication between its ports A and C. Thus, the fluid pressure is introduced through the first solenoid valve 80 from the oil pump 84 into the second pressure chamber 58 to move the second ring gear 42 leftward, as viewed in FIG. 5, away from the second ring gear 42 against the resilient force of the coil spring 56. The leftward and rightward movements of the second ring gear 42 are repeated and balanced to ensure that the second ring gear 42 can be retained at the predetermined intermediate position.

When the engine load decreases to a low value, the command current signal to the first solenoid valve 80 is interrupted. As a result, the first solenoid valve 80 changes to its first position providing communication of its ports A and B, as shown in FIG. 7, and it discharges the fluid pressure from the second pressure chamber 58. Since the fluid pressure charged in the first pressure chamber 54 decreases, the second ring gear 42 moves rightward, as viewed in FIG. 5, toward the first ring gear 40 until the second ring gear 42 reaches its rightmost position under the resilient force of the coil spring 56.

While the invention has been described in connection with intake valve timing control, it is to be understood that the invention is equally applicable to control the exhaust valve timing. While the invention has been described in conjunction with specific embodiments thereof, it is evident that many alternatives, modifications and variations will be apparent to those skilled in the art. For example, the first and second solenoid valves 80 and 82 may be removed and replaced with a single solenoid valve. Accordingly, it is intended to embrace all alternatives, modifications and variations that fall within the scope of the appended claims.

What is claimed is:

1. A valve timing control apparatus for use in an internal combustion engine having a crankshaft driven by the engine and a camshaft adapted to drive at least one valve, the valve timing control apparatus comprising:

a rotary member drivingly connected to the crankshaft for rotation with the crankshaft;

a drive mechanism for transmitting rotation of the rotary member to the camshaft, the drive mechanism including a piston member provided for reciprocation to rotate the camshaft with respect to the rotary member, the piston member having a fixed volume pressure chamber formed therein, the piston member being urged resiliently in a first direction, the piston member being movable in a second direction opposite to the first direction in response to a pressure introduced into the pressure chamber;

a first conduit having a first outlet for connection to the pressure chamber;

a second conduit having a second outlet for connection to the pressure chamber, the second outlet being spaced away from the first outlet in the first direction of movement of the piston member; and a control unit including means for producing first and second command signals according to engine operating conditions, means responsive to the first command signal for introducing a pressure through the first conduit, and means responsive to the second command signal for introducing a pressure through the second conduit.

2. The valve timing control apparatus as claimed in claim 1, wherein the drive mechanism includes a sleeve member mounted for rotation within the rotary drum, the sleeve member fixed to the camshaft for rotation in unison therewith, the sleeve member having an outer peripheral surface formed with an externally threaded portion, wherein the rotary drum has an inner peripheral surface formed with an internally threaded portion, and wherein the piston member has an outer peripheral surface formed with an externally threaded portion engaging with the internally threaded portion of the inner peripheral surface of the rotary drum and an inner peripheral surface formed with an internally threaded portion engaging with the externally threaded portion of the outer peripheral surface of the sleeve member.

3. The valve timing control apparatus as claimed in claim 2, wherein the piston member has an annular groove formed in the inner peripheral surface thereof to form the pressure chamber along with the outer peripheral surface of the sleeve member.

4. The valve timing control apparatus as claimed in claim 3, further including means for limiting the movement of the piston member in the first direction at a first position, and means for limiting the movement of the piston member in the second direction at a second position.

5. The valve timing control apparatus as claimed in claim 4, wherein the first outlet is formed in the sleeve member, the first outlet being connected to the pressure chamber when the piston member is at the first position and disconnected from the pressure chamber when the piston member is at the second position, and wherein the second outlet is formed in the sleeve member, the second outlet being connected to the pressure chamber when the piston member is at the second position and disconnected from the pressure chamber when the piston member is at the first position.

6. The valve timing control apparatus as claimed in claim 5, wherein the first outlet is connected to the pressure chamber when the piston member is at a predetermined intermediate position between the first and second positions, and wherein the second outlet is connected to the pressure chamber when the piston member moves over the intermediate position in the second direction.

7. The valve timing control apparatus as claimed in claim 6, wherein the control unit is responsive to a low engine load condition for interrupting the first and second command signals, wherein the control unit is responsive to an intermediate engine load condition for producing the first command signal and interrupting the second command signal, and wherein the control unit is responsive to a high engine load condition for producing the first and second command signals.

8. The valve timing control apparatus as claimed in claim 7, wherein the means for introducing a pressure through the first conduit includes a solenoid valve having a first port connected to the first conduit, a second port connected to an oil pump, and a drain port, the solenoid valve providing communication between the first and drain ports in the absence of the first command signal, the solenoid valve providing communication between the first and second ports in the presence of the first command signal.

9. The valve timing control apparatus as claimed in claim 8, wherein the first and second ports are connected to a bypass passage having an orifice, and wherein the drain port is connected to a relief valve.

10. The valve timing control apparatus as claimed in claim 1, wherein the means for introducing a pressure through the first conduit includes a solenoid valve having a first port connected to the first conduit, a second port connected to an oil pump, and a drain port, the solenoid valve providing communication between the first and drain ports in the absence of the first command signal, the solenoid valve providing communication between the first and second ports in the presence of the first command signal.

11. The valve timing control apparatus as claimed in claim 10, wherein the first and second ports are connected to a bypass passage having an orifice, and wherein the drain port is connected to a relief valve.

* * * * *